US009534573B2

(12) United States Patent
Ogura et al.

(10) Patent No.: US 9,534,573 B2
(45) Date of Patent: Jan. 3, 2017

(54) FUEL INJECTION VALVE

(71) Applicant: Hitachi Automotive Systems, Ltd., Hitachinaka-shi, Ibaraki (JP)

(72) Inventors: Kiyotaka Ogura, Hitachinaka (JP); Hideharu Ehara, Hitachinaka (JP); Motoyuki Abe, Tokyo (JP); Eiji Ishii, Tokyo (JP); Masanori Mifuji, Hitachinaka (JP); Atsushi Takaoku, Hitachinaka (JP); Takao Miyake, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 14/765,455

(22) PCT Filed: Jan. 24, 2014

(86) PCT No.: PCT/JP2014/051439

§ 371 (c)(1),
(2) Date: Aug. 3, 2015

(87) PCT Pub. No.: WO2014/119473

PCT Pub. Date: Aug. 7, 2014

(65) Prior Publication Data

US 2015/0361938 A1 Dec. 17, 2015

(30) Foreign Application Priority Data

Feb. 4, 2013 (JP) ..... 2013-019062

(51) Int. Cl.
*B05B 1/30* (2006.01)
*F02M 61/16* (2006.01)
*F02M 51/06* (2006.01)

(52) U.S. Cl.
CPC ..... *F02M 61/162* (2013.01); *F02M 51/0664* (2013.01); *F02M 51/0671* (2013.01)

(58) Field of Classification Search
CPC ..... F02M 51/061; F02M 51/0671; F02M 61/1826; F02M 61/168; F02M 61/1833; F02M 51/0614; F02M 51/0625
(Continued)

(56) References Cited

U.S. PATENT DOCUMENTS 4,974,565 A 12/1990 Hashimoto et al.
5,058,549 A 10/1991 Hashimoto et al.
(Continued)

FOREIGN PATENT DOCUMENTS

JP 60-261975 A 12/1985
JP 61-171869 U 10/1986
(Continued)

OTHER PUBLICATIONS

International Search Report (PCT/ISA/210) dated Mar. 18, 2014 with English translation (six pages).

*Primary Examiner* — Davis Hwu
(74) *Attorney, Agent, or Firm* — Crowell & Moring LLP

(57) ABSTRACT

An object of the invention is to provide a fuel injection valve that applies a swirl to an upstream side of a seat section to shorten spray penetration.

When flows into injection hole entries are indicated by arrows 101*a* to 106*a* and injection hole exit directions are indicated by arrows 201 to 206, an angle α defined by the inflow direction 101*a* and the exit direction 201 of an injection hole 71 can be increased. In a method for applying the twisted angle α, a side groove 15*a* on an outer peripheral side of a guide member 12*a* is set to be accompanied with a twist with respect to an axis O1. Furthermore, a flow passage area of the side groove 15*a* is set smaller than a flow passage area on an upstream side of the guide member 12*a*

*(Continued)* and is also set larger than a flow passage area of a seat section 7B that is constructed by a gap between a valve body 7 and an orifice cup 7.

17 Claims, 10 Drawing Sheets

(58) Field of Classification Search
USPC ..... 239/585.1, 585.3, 585.4, 585.5, 533.12
See application file for complete search history.

(56) References Cited

U.S. PATENT DOCUMENTS

| | | | | |
|---|---|---|---|---|
| 5,163,621 | A | 11/1992 | Kato et al. | |
| 5,544,816 | A * | 8/1996 | Nally | F02M 51/005 239/585.5 |
| 6,494,382 | B1 * | 12/2002 | Stier | F02M 51/0607 239/102.1 |
| 6,786,423 | B2 * | 9/2004 | Peterson, Jr. | F02M 61/1853 239/5 |
| 2009/0184185 | A1 * | 7/2009 | Lewis | F02M 47/027 239/585.5 |

FOREIGN PATENT DOCUMENTS

| | | | |
|---|---|---|---|
| JP | 1-273873 | A | 11/1989 |
| JP | 3-182682 | A | 8/1991 |
| JP | 6-147057 | A | 5/1994 |
| JP | 10-331746 | A | 12/1998 |
| JP | 2000-320429 | A | 11/2000 |
| JP | 2008-101499 | A | 5/2008 |
| JP | 2010-223026 | A | 10/2010 |

* cited by examiner

FUEL INJECTION VALVE

TECHNICAL FIELD

The present invention relates to a fuel injection valve for an automotive internal combustion engine.

BACKGROUND ART

A fuel injection valve of an electromagnetic type that is driven by an electrical signal from an engine control unit has widely been used in internal combustion engines of automobiles and the like.

As the fuel injection valve of this type, a port injection type that is attached to an intake pipe and indirectly injects fuel into a combustion chamber and a direct injection type that directly injects the fuel into the combustion chamber are available.

In the latter direct injection type, a spray shape defined by the injected fuel determines combustion performance. Thus, the spray shape needs to be optimized in order to obtain the desired combustion performance. Here, the optimization of the spray shape can be restated as a spray direction and a spray length.

As the fuel injection valve, a fuel injection valve including: a valve body provided to be slidable; drive means for driving the valve body; a valve seat which the valve body comes in contact with or separates from; and plural orifices provided on a downstream side of the valve seat, in which the plural orifices are formed in different angle directions with respect to a center axis of a nozzle has been known (see PTL 1). It has been known that a spray spouted from the fuel injection valve is substantially spouted in an axial direction in which an injection hole is processed. It is desired to increase processing accuracy in a direction of the injection hole for a type of fuel injection valve with plural injection holes (orifices) like the fuel injection valve described in PTL 1. It is also desired to control the length of the spray, which is spouted from each of the injection holes, to be short in order to avoid interference thereof with size of the inside of the combustion chamber, a shape of a piston surface, and air-control valves (an intake valve and an exhaust valve) as much as possible and to reduce a chance of production of exhaust gas components (particularly, soot and the like that are components of unburned gas).

The spray lengths of the plural injection holes are not taken into consideration for the fuel injection valve described in PTL 1. It is considered to change hole diameters of the plural injection holes as a method for controlling the spray length of each of the injection holes. In general, while a dimension of the hole diameter is set large for the injection hole that requires the long spray length, the dimension of the hole diameter is set small for the injection hole that only requires the short spray length. In this way, the spray length of each of the injection holes can be controlled.

CITATION LIST

Patent Literature

PTL 1: JP-A-2008-101499

SUMMARY OF INVENTION

Technical Problem

For a conventional fuel injection valve, plural working tools that correspond to the plural injection holes need to be prepared when the hole diameters of the plural injection holes are changed, and the different tool needs to be used to process each of the injection holes. Thus, manufacturing cost of the fuel injection valve is high. An object of the invention is to provide a fuel injection valve that applies a swirling component to an entry of each injection hole, so as to control a length of a spray spouted from each of the injection holes to be short.

Solution to Problem

In the invention, in a fuel injection valve that includes: plural injection holes; a seat section provided on an upstream side of the injection hole; a valve body that is brought into a valve closed state when contacting the seat section and brought into a valve open state when separating from the seat section; and a conical shaped section in a substantially conical shape that is formed with an entry-side opening of the injection hole and the seat section and is tapered from the upstream side to a downstream side, a fluid inflow direction to the plural injection holes is in a relationship in which plural fuel passages are formed from a phase of an upstream section of the seat section to the seat section, and the fuel passages are twisted with respect to a center axis of a fuel injection valve main body.

Advantageous Effects of Invention

According to the invention, the fuel injection valve can be provided that can suppress adhesion of fuel to the inside of a combustion chamber and a piston by controlling a length of a spray spouted from the injection hole and thus can improve exhaust performance (particularly, suppression of unburned components).

DESCRIPTION OF EMBODIMENTS

An example according to the invention will be described with reference to the following drawings.

Figure 1:
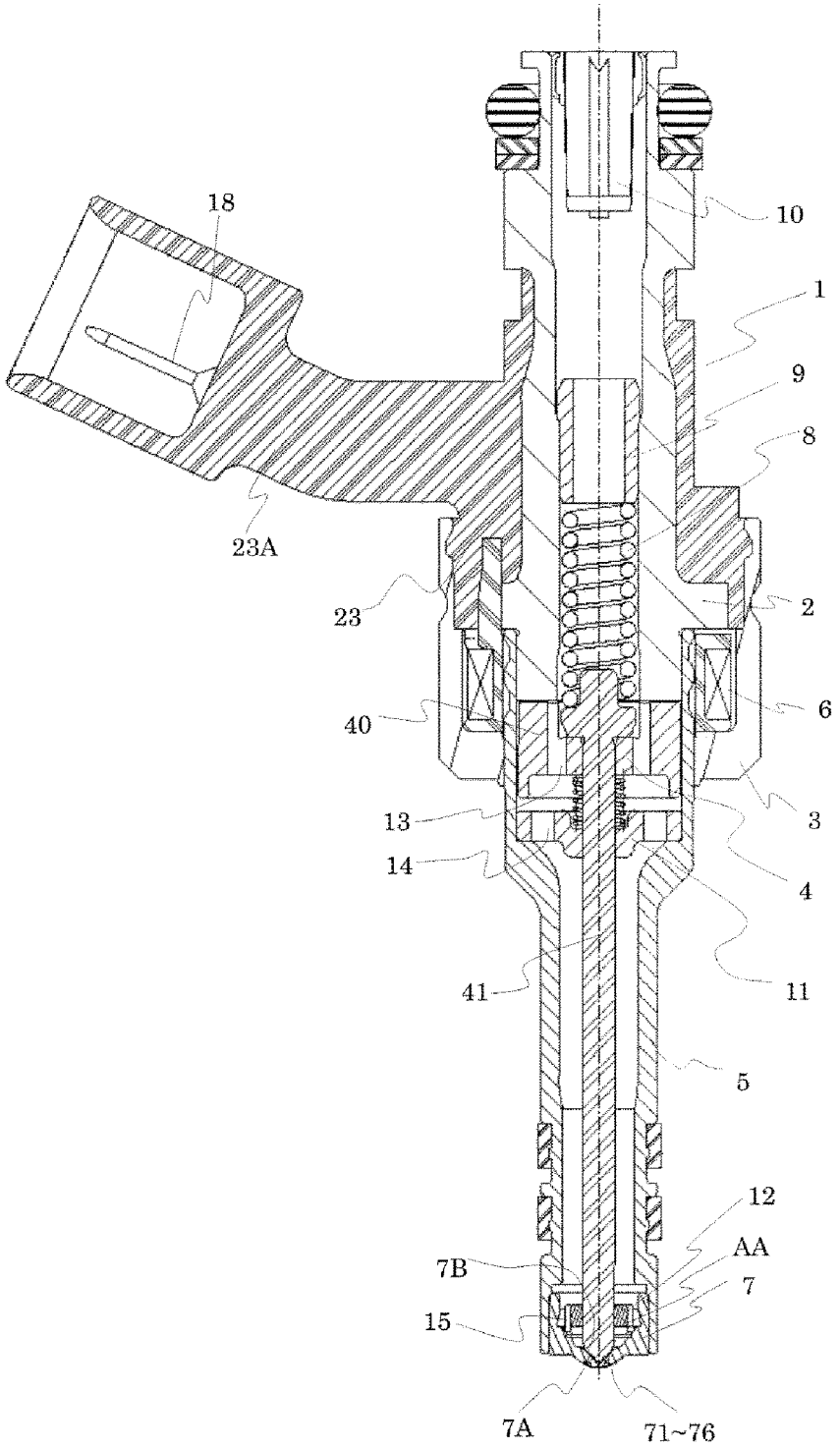
FIG. 1 is a vertical cross-sectional view of an overall configuration of a fuel injection valve according to one example of the invention.

FIG. 1 is a vertical cross-sectional view of an overall configuration of a fuel injection valve according to one example of the invention. The fuel injection valve of this example is a fuel injection valve that directly injects fuel such as gasoline into a cylinder (a combustion chamber) of an engine.

A fuel injection valve main body 1 has a hollow fixed core 2, a yoke 3 that also serves as a housing, a movable element 4, and a nozzle body 5. The movable element 4 is formed of a movable core 40 and a movable valve body 41. The fixed core 2, the yoke 3, the movable core 40 are components of a magnetic circuit.

The yoke 3, the nozzle body 5, and the fixed core 2 are coupled by welding. Various types are available for this coupling mode. In this example, the nozzle body 5 and the fixed core 2 are welded and coupled in a state that a portion of an inner periphery of the nozzle body 5 is fitted to a portion of an outer periphery of the fixed core 2. Furthermore, the yoke 3 surrounds a portion of an outer periphery of this nozzle body 5, and the nozzle body 5 and the yoke 3 are thereby welded and coupled. An electromagnetic coil 6 is embedded on the inside of the yoke 3. The electromagnetic coil 6 is covered with the yoke 3, a resin cover 23, and a portion of the nozzle body 5 and thus keeps a sealing property thereof.

The movable element 4 is embedded in the nozzle body 5 in a manner capable of moving in an axial direction. An orifice cup 7 that serves as a portion of the nozzle body is fixed to a tip of the nozzle body 5 by welding. The orifice cup 7 has injection holes (orifices) 71 to 76, which will be described below, and a conical surface 7A that includes a seat section 7B.

A spring 8 for pressing the movable element 4 against the seat section 7B, an adjuster 9 for adjusting a spring force of this spring 8, and a filter 10 are embedded in the fixed core 2.

A guide member 12 for guiding axial movement of the movable element 4 is provided in the nozzle body 5 and the orifice cup 7. The guide member 12 is fixed to the orifice cup 7. It should be noted that a guide member 11 for guiding the axial movement of the movable element 4 at a position near the movable core 40 is provided and that the axial movement of the movable element 4 is guided by the guide members 11 and 12 arranged vertically.

As the valve body (a valve rod) 41 of this example, a needle type, a tip of which is tapered, is depicted. However, it may be a type, a tip of which is provided with a ball.

A fuel passage in the fuel injection valve is configured by including the inside of the fixed core 2, plural holes 13 provided in the movable core 40, plural fuel passages 14 provided in the guide member 11, the inside of the nozzle body 5, plural side grooves 15 provided in the guide member 12, and the conical surface 7A including the seat section 7B.

The resin cover 23 is provided with a connector section 23A for supplying an excitation current (a pulse current) to the electromagnetic coil 6, and a portion of a lead terminal 18 that is insulated by the resin cover 23 is positioned in the connector section 23A.

When the electromagnetic coil 6, which is stored in the yoke 3, is excited by an external drive circuit (not depicted) via this lead terminal 18, the fixed core 2, the yoke 3, and the movable core 40 form the magnetic circuit, and the movable element 4 is magnetically attracted to the fixed core 2 side against the force of the spring 8. At this time, the movable valve body 41 separates from the seat section 7B and is brought into a valve open state. Then, the fuel in the fuel injection valve main body 1, pressure of which is increased in advance (to 1 MPa or higher) by an external high-pressure pump (not depicted), is injected from the injection holes 71 to 76.

When the excitation of the electromagnetic coil 6 is shut off, the valve body 41 is pressed against the seat section 7B side by the force of the spring 8 and is brought into a valve closed state.

Here, a description will be made on a main fuel passage that passes through the seat section 7B from the guide member 12 and reaches the injection holes 71 to 76. When a fluid flows downstream from the guide member 12, a flow thereof is divided to flow into a slight gap AA formed by the guide member 12 and the movable valve body 41 and into the plural side grooves 15 provided in the guide member 12. An area of the gap AA is much smaller than an area defined by the side grooves 15, and the fluid flow is concentrated in the side grooves 15. For this reason, a passage of the flow that passes through the side grooves 15, passes through the seat section 7B, and reaches the injection holes 71 to 76 is referred to as the main flow passage.

Figure 2:
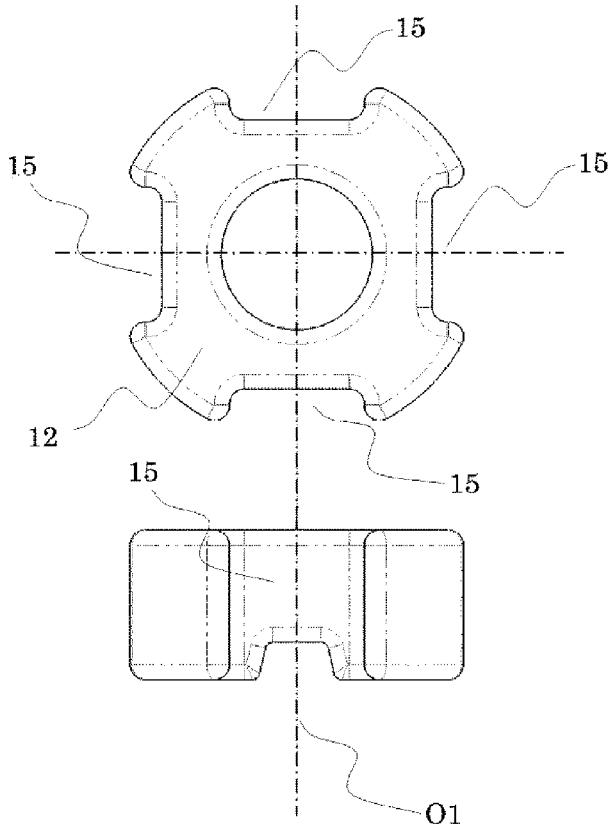
FIG. 2 includes a top view and a side view of a conventional guide member.
Figure 3:
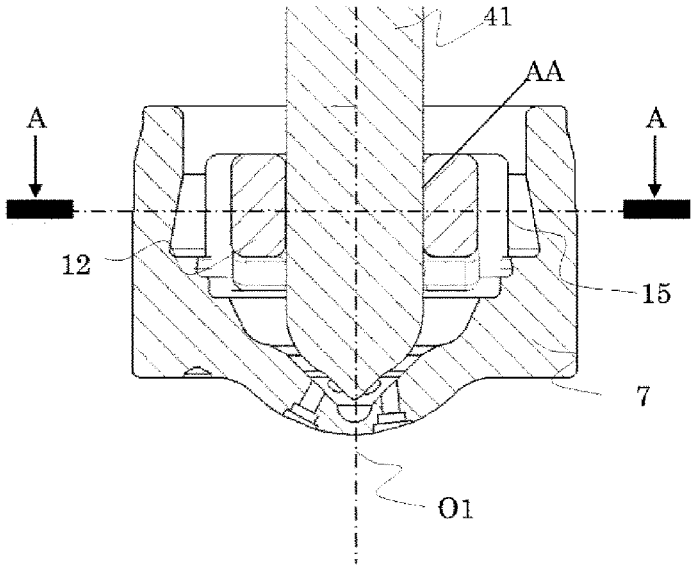
FIG. 3 is a vertical cross-sectional view of vicinity of an orifice cup and the conventional guide member.
Figure 4:
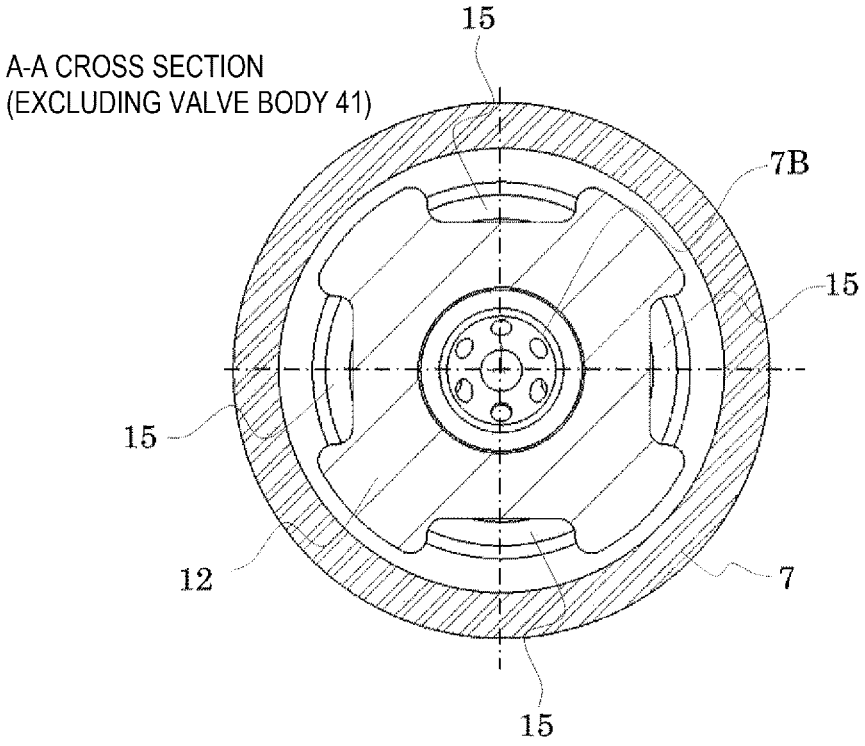
FIG. 4 is a cross-sectional view taken along A-A in FIG. 3 and depicts a seat section from an upstream side.
Figure 5:
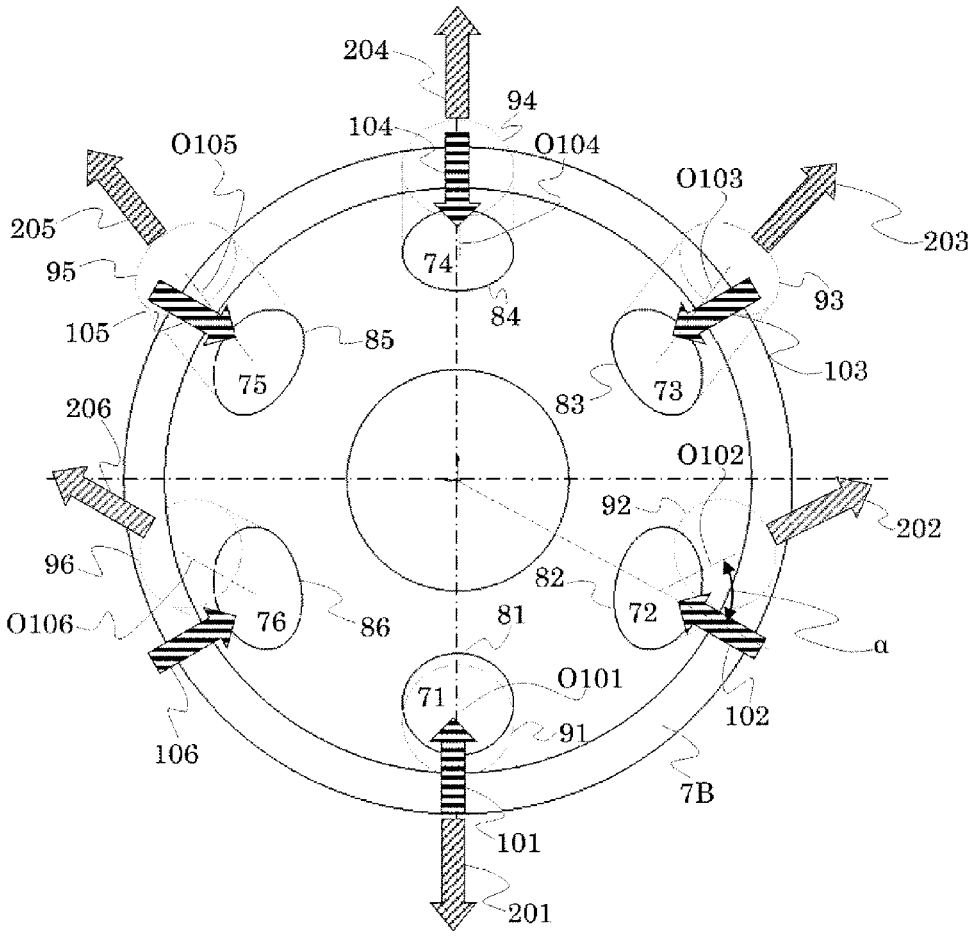
FIG. 5 is an enlarged view of the vicinity of the seat section in FIG. 4 and depicts a state of inflow to and outflow from an injection hole.

As depicted in FIG. 2, the side groove 15 of the conventional guide member 12 forms the fuel passage such that the fuel passage becomes parallel to a fuel injection valve axis O1. Thus, the fluid, which is after the fuel passes through the side groove 15, flows in a concentrated manner as a flow passage area is decreased toward the seat section 7B. Meanwhile, a vector of the flow passes in substantially the same directions as a direction along the conical surface of the orifice cup 7 and a direction of the fuel injection valve axis O1. FIG. 4 depicts a cross section taken along A-A in FIG. 3. In a state that the orifice cup 7 is seen from the upstream side, a state that the valve body 41 is removed is depicted, so as to depict the seat section 7B. The fluid flows in the vicinity of this seat section 7B are depicted in FIG. 5. As described above, the flow advances in substantially the same directions as the conical surface and the fuel injection valve axis O1. Thus, a mode is adopted, in which, when passing the seat section 7B, the fluid flows in a fuel injection valve center direction from the outside of the conical surface in a substantially radial manner. Inflow arrows 101 to 106 to the injection holes 71 to 76 substantially face a fuel injection valve center axis direction.

Here, entries of the injection holes 71 to 76 are respectively indicated by solid lines 81 to 86, exits thereof are respectively indicated by dotted lines 91 to 96, and injection hole exit directions thereof are respectively indicated by arrows 201 to 206. In addition, an axis that passes through the center of the injection hole entry 81 and the center of the injection hole exit 91 is denoted as O101. Similarly, a center axis of each of the injection holes is denoted as O102. A flow in the injection hole 71 along a surface that passes through the axis O101 and the fuel injection valve axis O1 is depicted in FIG. 6, and a flow along a surface that is perpendicular to the axis O101 and passes the injection hole exit 91 is depicted in FIG. 7.

Figure 6:
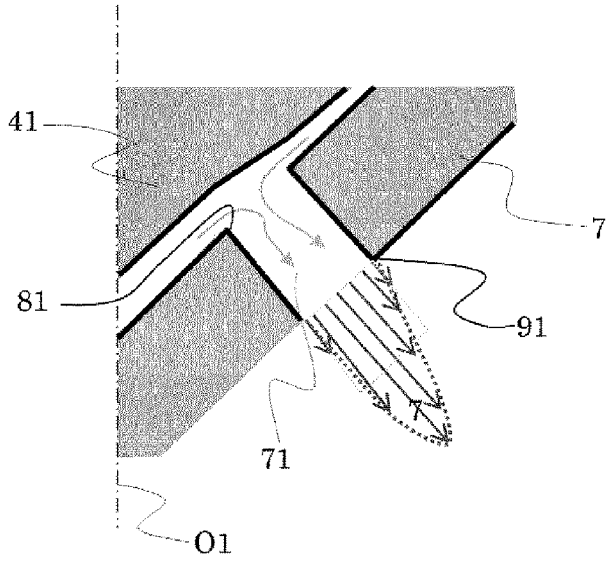
FIG. 6 is a transverse cross-sectional view of an injection hole 71 in FIG. 5.
Figure 7:
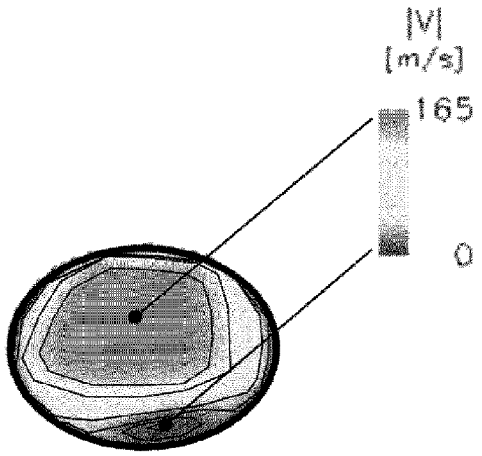
FIG. 7 is a contour diagram of an exit section 81 of the injection hole 71 in FIG. 5.
Figure 8:
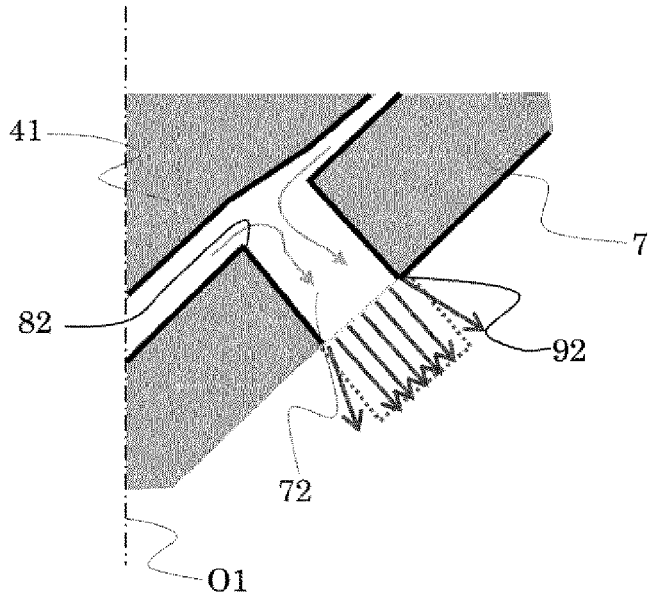
FIG. 8 is a transverse cross-sectional view of an injection hole 72 in FIG. 5.
Figure 9:
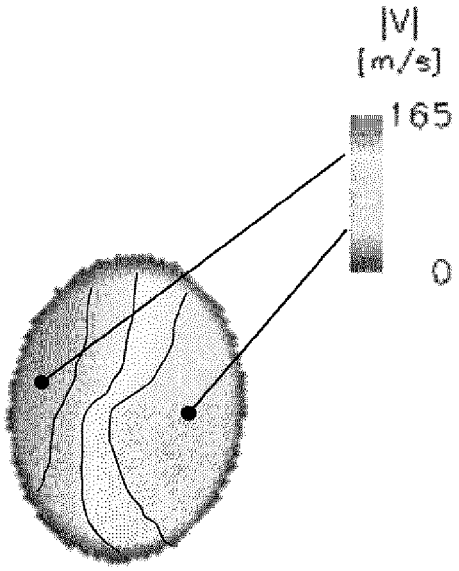
FIG. 9 is a contour diagram of an exit section 82 of the injection hole 72 in FIG. 5.

Since an inflow direction 101 and the exit direction 201 match substantially in the injection hole 71, a speed component in the axis O101 in FIG. 6 is large. Thus, the fluid from the injection hole exit 91 is spouted while the high-speed component in a vertical axis direction is retained.

Meanwhile, an angle α (α; 0 degrees to 90 degrees) that is defined by an inflow direction 102 and the exit direction 202 is applied to the injection hole 82. A twisting effect is generated in the fluid in the injection hole by this angle α. It can be understood that a speed in a surface component direction that is perpendicular to the axis O102 direction (hereinafter referred to as an in-plane flow speed) is applied by this twist. Due to the application of this in-plane flow speed, when the fluid is spouted from the injection hole exit 82, the speed in the axis O102 direction is decreased, and the fluid is advanced in the surface direction that is perpendicular to the axis O102, that is, a spreading direction.

Figure 10:
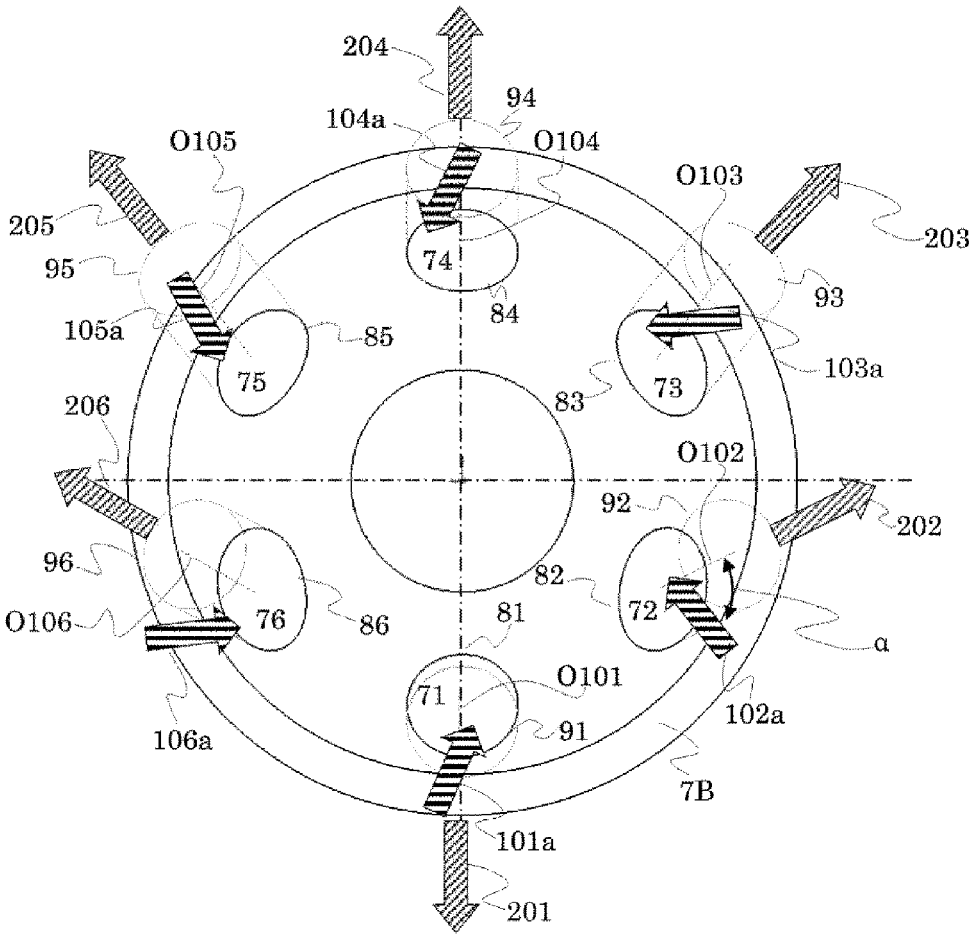
FIG. 10 is an enlarged view of the vicinity of the seat section with a twisted angle according to the example of the invention and depicts the state of inflow to and outflow from the injection hole.

An example that is the invention for actively applying the twist angle α depicted in the injection hole 82 to each of the injection holes is described below. As depicted in FIG. 10, when the inflow to the injection hole entries is indicated by arrows 101*a* to 106*a*, and the injection hole exit directions are indicated by the above-described arrows 201 to 206, the angle α defined by the inflow direction 101*a* and the exit direction 201 of the injection hole 71 can be increased with respect to the injection port 71 in FIG. 5. It can be understood that the twisting effect of the fluid in the injection hole can thereby be increased.

In particular, this effect appears significantly in the case where the angle α that is defined by the injection hole inflow direction 101 (and the inflow direction 104) and the injection hole exit direction 201 (and the exit direction 204) is substantially 0 degree as in the injection hole 71 and the injection hole 74 depicted in FIG. 5.

Meanwhile, a twisted angle that is defined by the inflow direction 106*a* and the injection hole exit direction 206 of the injection hole 76 depicted in FIG. 10 tends to be smaller than the twisted angle depicted in FIG. 5. However, the flow in the inflow direction 106 is accompanied with the twisted component when flowing into the injection hole 76. Thus, the in-plane flow speed can be applied thereto by an effect of a swirling component that is generated in the injection hole 76 with respect to an effect of the reduced twisted angle.

Figure 11:
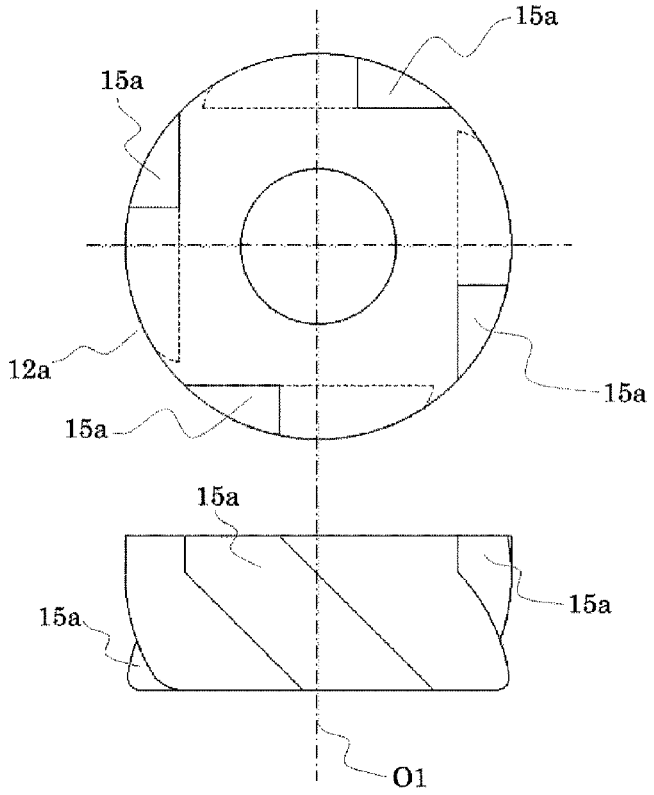
FIG. 11 includes a top view and a side view of a guide member that depicts an embodiment of the invention.

A description will be made on a method for applying the twisted angle α as the invention. FIG. 11 includes a top view from the upstream side and a side view of a guide member 12*a* as the invention. The guide member 12*a* is formed with a side groove 15*a* in an upstream section and connected to the downstream side. The plural side grooves 15*a* may be provided. As depicted in the top view and the side view, the side groove 15*a* has a structure that is accompanied with a twist with respect to the axis O1.

Figure 12:
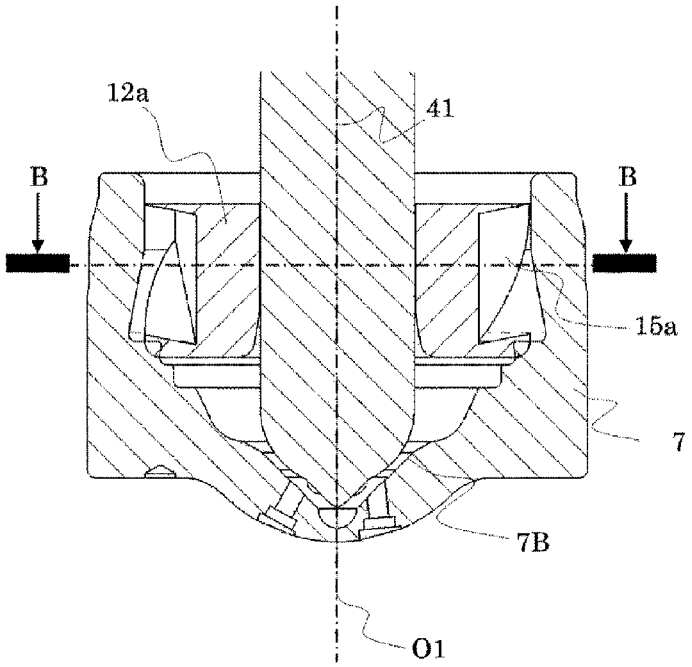
FIG. 12 is a vertical cross-sectional view of the vicinity of the orifice cup and the guide member in FIG. 11.
Figure 13:
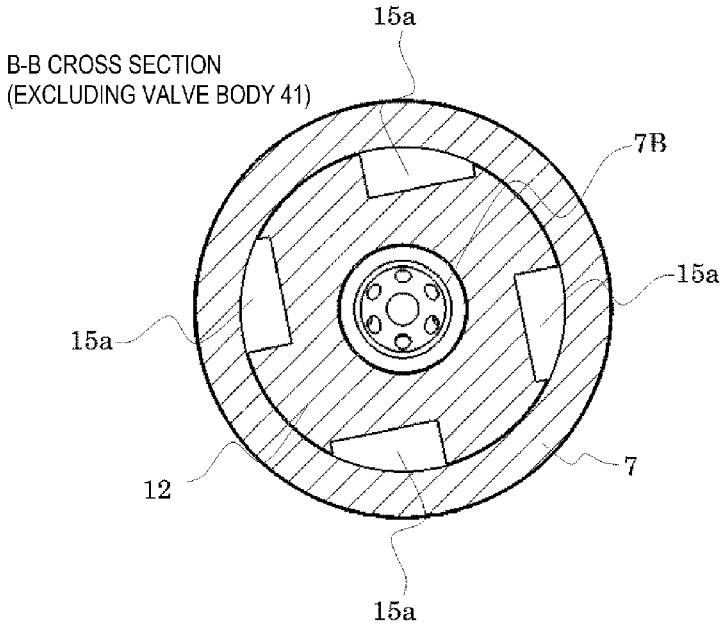
FIG. 13 is a cross-sectional view taken along B-B in FIG. 12 and depicts the seat section from the upstream side.

FIG. 12 is a cross-sectional view in which the guide member 12*a* and the orifice cup 7 are combined. An outer periphery of the guide member 12*a* is structured to substantially contact an inner peripheral surface of the orifice cup 7. In this way, a groove formed by the side groove 15*a* and an inner periphery of the orifice cup 7 serves as the main fuel passage. Here, a gap formed between the movable valve body 41 and an inner peripheral surface of the guide member 12*a* has substantially the same configuration as that in FIG. 2. With the configuration as described above, the fuel that passes through the side groove 15*a* obtains the twisted component and flows through a gap between the valve body 41 and the orifice cup 7 in a downstream region after passing the guide member 12*a*, passes through the seat section 7B, and flows into each of the injection ports 71 to 76.

Furthermore, in the invention, a flow passage area of the side groove 15*a* of the guide member 12*a* is set smaller than a flow passage area on the upstream side of the guide member 12*a*. Moreover, the flow passage area of the side groove 15*a* is set larger than a flow passage area of the seat section 7B that is constructed by the gap between the valve body 7 and the orifice cup 7. First, an effect in increasing a spray swirling force that is generated in the side groove 15*a* can be expected by decreasing the flow passage area from the upstream side. Secondly, the flow passage needs to be used in a range where the flow passage area is set larger than that of the seat section 7B and thus an intermediate flow passage area is not locally decreased. It is conditioned that the flow passage area of the side groove 15*a* is larger than 0.18 $mm^2$ and smaller than 8.1 $mm^2$.

Figure 14A:
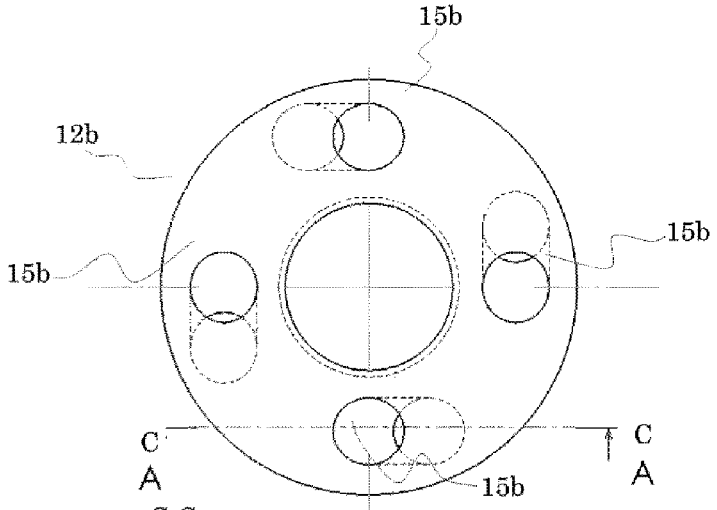
FIG. 14A is a top view of a guide member that depicts another embodiment of the invention.
Figure 14B:
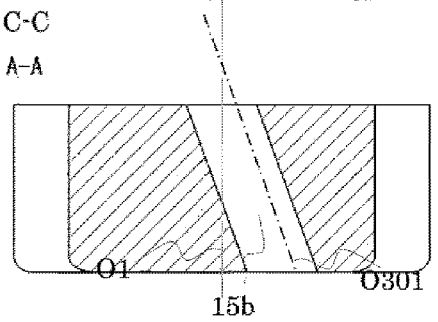
FIG. 14B is a cross-sectional view taken along C-C in FIG. 14A.

FIG. 14A is a top view of a guide member 12*b* as another embodiment of this example. A fuel passage 15*b* that penetrates the guide 12*b* from the upstream side to the downstream side is constructed. The plural fuel passages 15*b* may be constructed. FIG. 14B is a transverse cross-sectional view of the fuel passage 15*b*. A center line O301 of the fuel passage 15*b* is configured to have a twisted relationship with the fuel injection valve axis O1. A shape of the fuel passage 15*b* is substantially a true circle as a matter of convenience. However, the shape is not particularly limited as long as the above-described flow passage area is established.

Figure 15A:
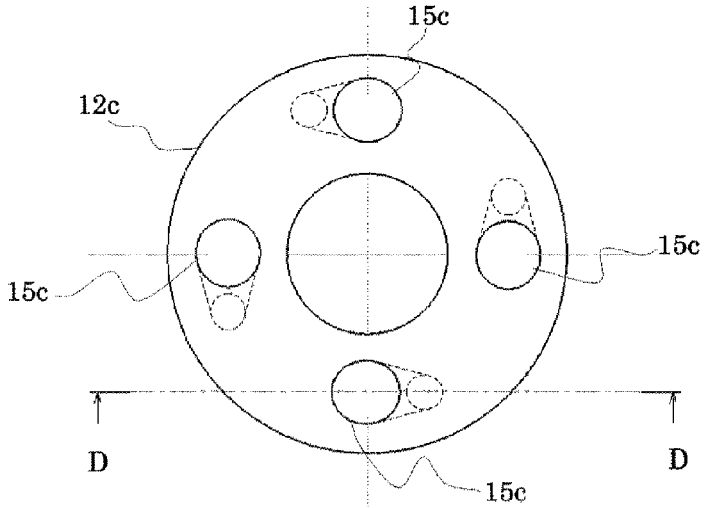
FIG. 15A is a top view of a guide member that depicts yet another embodiment of the invention.
Figure 15B:
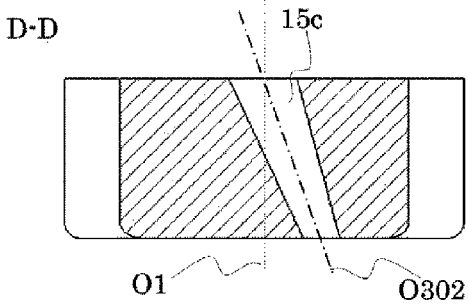
FIG. 15B is a cross-sectional view taken along D-D in FIG. 15A.

FIG. 15A is a top view of a guide member 12*c* as yet another embodiment of this example. A fuel passage 15*c* that penetrates the guide member 12*c* from the upstream side to the downstream side is constructed, and a flow passage area of the fuel passage 15*c* may be decreased at an exit on the downstream side. FIG. 15B is a transverse cross-sectional view of the fuel passage 15*c*, and similar to the guide member 12*b*, a center line O302 is configured to have a twisted relationship with the fuel injection valve axis O1. In addition, a shape of the fuel passage 15*c* is substantially deep as a matter of convenience.

Manufacturing methods for these guide members 12*a*, 12*b*, 12*c* described above are not limited to machining, pressing, and the like, but sintering, an MIM, lost wax, and the like are also considered. Furthermore, with a member in which the guide member (12*a*, 12*b*, 12*c*) is integrated with the orifice cup 7, shortening of spray penetration, which is an effect of the invention, can sufficiently be obtained.

In addition, as a method for shortening the spray penetration, setting of a stroke amount in a way that a speed of the fluid flowing through the gap (a so-called stroke) constructed by the valve body 7 and the seat section 7B in the orifice cup 7, that is, a seat section flow speed exceeds a certain value is combined with the fuel injection valve that constitutes the guide member of the invention. In this way, the spray penetration can further be shortened.

Furthermore, in the case where the shapes of the injection hole entries, which are formed in the fuel injection valve for constituting the guide member of the invention and the orifice cup, are set as the substantially true circles, the shapes on the exit side are set as ovals, and furthermore, an oval shaft (may be either a long shaft or a short shaft in this case) has a twisted angle β with respect to the inflow angle. When this combination is adopted, an effect of the fluid twisted force is applied to the inside of each of the injection holes, and thus a swirl flow is intensified. In this way, the spray penetration can further be shortened.

REFERENCE SIGNS LIST

1 Fuel injection valve main body
2 Fixed core

3 Yoke
4 Movable element
5 Nozzle body
6 Electromagnetic coil
7 Orifice cup
8 Spring
9 Adjuster
10 Filter
11 Guide member
12 Guide member
13 Fuel passage
14 Fuel passage
15 Side groove
18 Lead terminal
23 Resin cover
23A Connector section
40 Movable core
41 Movable valve body
71 to 76 Injection hole
7A Conical surface
7B Seat section
81 to 86 Injection hole entry
91 to 96 Injection hole exit
101 to 106 Injection hole inflow direction
101*a* to 106*a* Injection hole inflow direction
201 to 206 Injection hole exit direction
O1 Fuel injection valve center axis
O101 to O106 Injection hole center axis
12*a* Guide member
15*a* Guide member side groove
12*b* Guide member
15*b* Guide member side groove
12*c* Guide member
15*c* Guide member side groove

The invention claimed is:

1. A fuel injection valve comprising:
an injection hole;
a seat section provided on an upstream side of the injection hole; and
a valve body that is brought into a valve closed state when contacting the seat section and is brought into a valve open state when separating from the seat section, wherein
a fixed member by which a fuel passage is formed on an outer peripheral side of the valve body in an upstream section of the seat section is provided, and the fuel passage of the fixed member is formed to be inclined with respect to a center axis of the fuel injection valve, and
the fixed member is arranged on the outer peripheral side of the valve body and constructed of a guide member for guiding the valve body, and the fuel passage is constructed in an outer peripheral section of the guide member.

2. The fuel injection valve according to claim 1, wherein the fuel passage has a twisted relationship with a center axis of a fuel injection valve main body.

3. The fuel injection valve according to claim 1, wherein the fuel passage is formed by being penetrated from an upstream side to a downstream side.

4. The fuel injection valve according to claim 1, wherein a flow passage area of the guide member is smaller than an upstream flow passage area of the guide member and is larger than a flow passage area of the seat section.

5. The fuel injection valve according to claim 1, wherein the seat section and the fixed member are formed of the same part.

6. The fuel injection valve according to claim 1, wherein the fuel passage is formed such that an upstream side flow passage area is smaller than a downstream side flow passage area.

7. The fuel injection valve according to claim 1, wherein the fixed member is constructed of a separate body from a casing that is arranged on the outer peripheral side of the valve body.

8. The fuel injection valve according to claim 1, wherein the fixed member is constructed of a separate body from the valve body.

9. The fuel injection valve according to claim 1, wherein the fuel injection valve is a direct injection type for directly injecting fuel into a combustion chamber.

10. The fuel injection valve according to claim 1, wherein the four fuel passages are formed in the fixed member.

11. A fuel injection valve comprising:
an injection hole;
a seat section provided on an upstream side of the injection hole; and
a valve body that is brought into a valve closed state when contacting the seat section and is brought into a valve open state when separating from the seat section wherein
a fixed member by which a fuel passage is formed on an outer peripheral side of the valve body in an upstream section of the seat section is provided, and an entry surface section and an exit surface section of the fuel passage are formed at displaced positions from each other in a top view of the fixed member, and
the fixed member is arranged on the outer peripheral side of the valve body and constructed of a guide member for guiding the valve body, and the fuel passage is constructed in an outer peripheral section of the guide member.

12. The fuel injection valve according to claim 11, wherein the fuel passage has a twisted relationship with a center axis of a fuel injection valve main body.

13. The fuel injection valve according to claim 11, wherein a flow passage area of the guide member is smaller than an upstream flow passage area of the guide member and is larger than a flow passage area of the seat section.

14. The fuel injection valve according to claim 11, wherein the fuel passage is formed such that an upstream side flow passage area is smaller than a downstream side flow passage area.

15. A fuel injection valve comprising:
an injection hole;
a seat section provided on an upstream side of the injection hole; and
a valve body that is brought into a valve closed state when contacting the seat section and is brought into a valve open state when separating from the seat section, wherein
a fixed member by which a fuel passage is formed on an outer peripheral side of the valve body in an upstream section of the seat section is provided, an outer peripheral section of the fixed member is formed to be recessed to an inner peripheral side, and the fuel passage is thereby formed, and
the fixed member is arranged on the outer peripheral side of the valve body and constructed of a guide member for guiding the valve body, and the fuel passage is constructed in an outer peripheral section of the guide member.

16. The fuel injection valve according to claim 15, wherein the fuel passage has a twisted relationship with a center axis of a fuel injection valve main body.

17. The fuel injection valve according to claim 15, wherein a flow passage area of the guide member is smaller than an upstream flow passage area of the guide member and is larger than a flow passage area of the seat section.

* * * * *